US005730689A

United States Patent [19]

Haugen

[11] Patent Number: 5,730,689

[45] Date of Patent: Mar. 24, 1998

[54] ARTICULATING PULL HANDLE

[76] Inventor: Ronald D. Haugen, 1600 Highland Dr., Unit 3, Hollister, Calif. 95023

[21] Appl. No.: 783,552

[22] Filed: Jan. 14, 1997

Related U.S. Application Data

[63] Continuation-in-part of Ser. No. 680,017, Jul. 15, 1996, abandoned.

[51] Int. Cl.[6] ..... A63B 23/035

[52] U.S. Cl. ..... 482/139; 482/102

[58] Field of Search ..... 482/93, 102, 106, 482/103, 139, 148

[56] References Cited

U.S. PATENT DOCUMENTS 5,080,349 1/1992 Vittone ..... 482/139 X
5,407,405 4/1995 Oren ..... 482/139 X

FOREIGN PATENT DOCUMENTS 1643025 4/1991 U.S.S.R. ..... 482/102

*Primary Examiner*—Richard J. Apley
*Assistant Examiner*—John Mulcahy

[57] ABSTRACT

An Articulating Pull Handle having a U-shaped pull yoke having a lug for connecting to a cable, an oval pull ring pivotally connected between the ends of the yoke, and a pair of parallel handles mounted between the sides of the ring orthogonally to the pivot axis. In use, the Articulating Pull Handle is coupled to the pull cable for coupling to the tensile load of a weight machine and as the user pulls on the vertical handles, and the angle of arm and forearm action changes, the pull ring pivots to accommodate the change and thereby reduces the stress and strain on the wrist of the user and is therefore more comfortable and effective for the user.

8 Claims, 3 Drawing Sheets

ARTICULATING PULL HANDLE

CROSS REFERENCE TO RELATED APPLICATION

This application is a continuation-in-part of my prior application Ser. No. 08/680,017, filed Jul. 15, 1996 and now abandoned.

BACKGROUND OF THE INVENTION

1. Field of the Invention

The present invention relates to weight machine pull handles and more particularly pertains to a new Articulating Pull Handle for offering a pull handle that is simpler and more effective than previously known weight machine pull handles.

2. Description of the Prior Art

The use of weight machine pull handles is known in the prior art. More specifically, weight machine pull handles heretofore devised and utilized are known to consist basically of familiar, expected and obvious structural configurations, notwithstanding the myriad of designs encompassed by the crowded prior art which have been developed for the fulfillment of countless objectives and requirements.

Known prior art weight machine pull handles include U.S. Pat. No. 4,461,473; U.S. Pat. No. 5,407,405; U.S. Pat. Des. 293,124; U.S. Pat. No. 5,080,349; U.S. Pat. No. 4,822,035; and U.S. Pat. No. 4,690,400.

While these devices fulfill their respective, particular objectives and requirements, the aforementioned patents do not disclose a new Articulating Pull Handle. The inventive device includes a pull yoke, a pull ring, a horizontal pivot axis, and a vertical handle.

In these respects, the Articulating Pull Handle according to the present invention substantially departs from the conventional concepts and designs of the prior art, and in so doing provides an apparatus primarily developed for offering a pull handle that isolates the upper arm muscles by keeping the hand parallel with the pull cable while rotating freely in the yoke.

SUMMARY OF THE INVENTION

In view of the foregoing disadvantages inherent in the known types of weight machine pull handles now present in the prior art, the present invention provides a new Articulating Pull Handle construction wherein the same can be utilized for offering a pull handle that is simpler and yet more effective in design than previously known weight machine pull handles.

The general purpose of the present invention, which will be described subsequently in greater detail, is to provide a new Articulating Pull Handle apparatus and method which has many of the advantages of the weight machine pull handles mentioned heretofore and many novel features that result in a new Articulating Pull Handle which is not anticipated, rendered obvious, suggested, or even implied by any of the prior art weight machine pull handles, either alone or in any combination thereof.

To attain this, the present invention generally comprises a pull yoke, a pull ring, a horizontal pivot axis, and a vertical handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the offering a pull handle that is simpler in design and yet more effective than previously known weight machine pull handles, of description and should not be regarded as limiting.

As such, those skilled in the art will appreciate that the conception, upon which this disclosure is based, may readily be utilized as a basis for the designing of other structures, methods and systems for carrying out the several offering a pull handle that is simpler and yet more effective in design than previously known weight machine pull handles of the present invention. It is important, therefore, that the claims be regarded as including such equivalent constructions insofar as they do not depart from the spirit and scope of the present invention.

Furthermore, the offering of a pull handle that is simpler and more effective in design than previously known weight machine pull handles of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Articulating Pull Handle apparatus and method which has many of the advantages of the weight machine pull handles mentioned heretofore and many novel features that result in a new Articulating Pull Handle which is not anticipated, rendered obvious, suggested, or even implied by any of the prior art weight machine pull handles, either alone or in any combination thereof.

It is another object of the present invention to provide a new Articulating Pull Handle which may be easily and efficiently manufactured and marketed.

It is a further object of the present invention to provide a new Articulating Pull Handle which is of a durable and reliable construction.

An even further object of the present invention is to provide a new Articulating Pull Handle which is susceptible of a low cost of manufacture with regard to both materials and labor, and which accordingly is then susceptible of low prices of sale to the consuming public, thereby making such Articulating Pull Handle economically available to the buying public.

Still yet another object of the present invention is to provide a new Articulating Pull Handle which provides in the apparatuses and methods of the prior art some of the advantages thereof, while simultaneously overcoming some of the disadvantages normally associated therewith.

Still another object of the present invention is to provide a new Articulating Pull Handle for offering a pull handle that is simpler in design and yet more effective than previously known weight machine pull handles.

Yet another object of the present invention is to provide a new Articulating Pull Handle which includes a pull yoke, a pull ring, a horizontal pivot axis, and a vertical handle.

Still yet another object of the present invention is to provide a new Articulating Pull Handle that takes away stress and strain from the user's wrists.

Even still another object of the present invention is to provide a new Articulating Pull Handle that has two compensation axis' for user wrist comfort.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
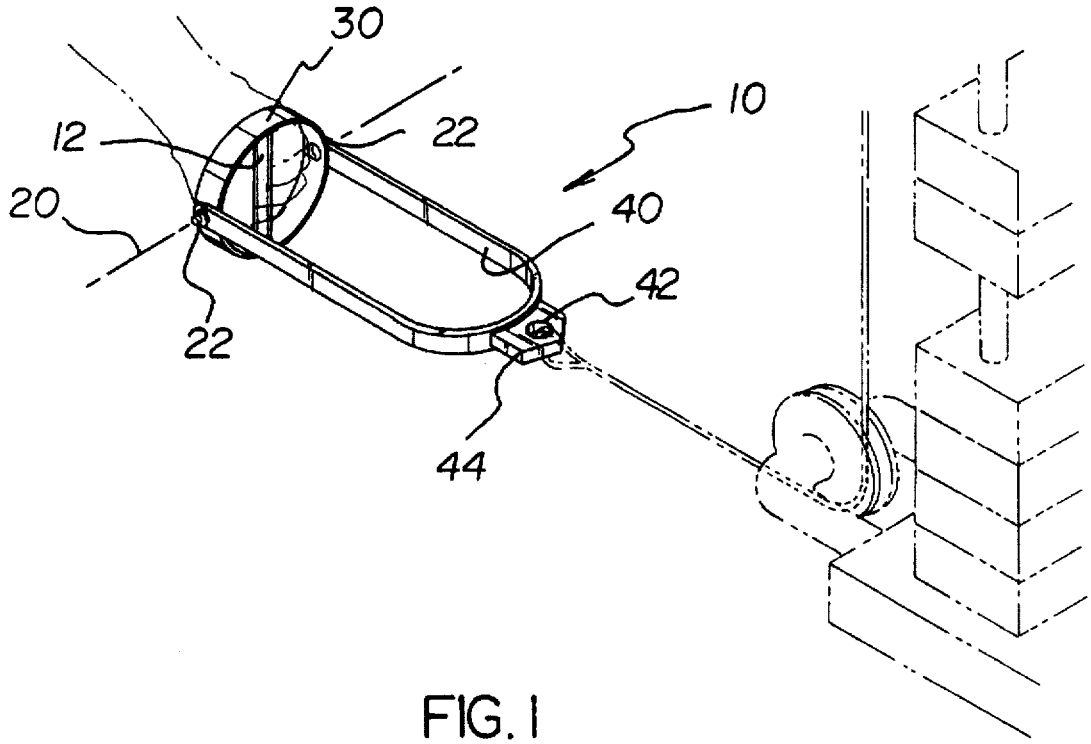
FIG. 1 is a right side perspective view of a new Articulating Pull Handle according to the present invention.
Figure 2:
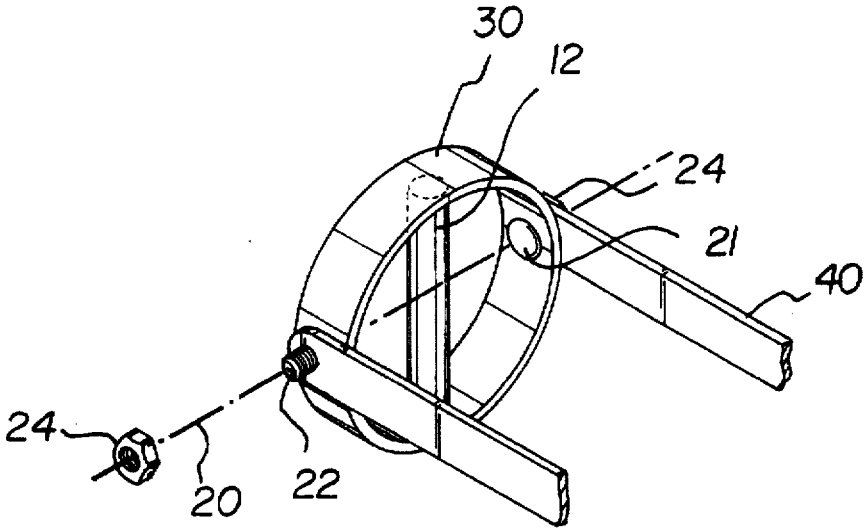
FIG. 2 is an enlarged right side perspective view of a vertical handle and horizontal pivot axis of a new Articulating Pull Handle according to the present invention.
Figure 4:
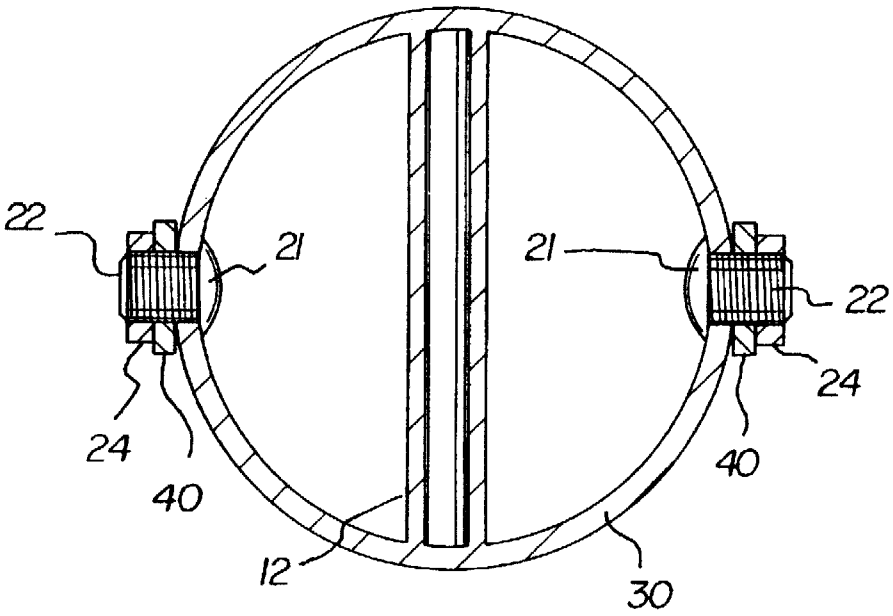
FIG. 4 is a cross sectional view taken along line 4—4 of FIG. 3.
Figure 3:
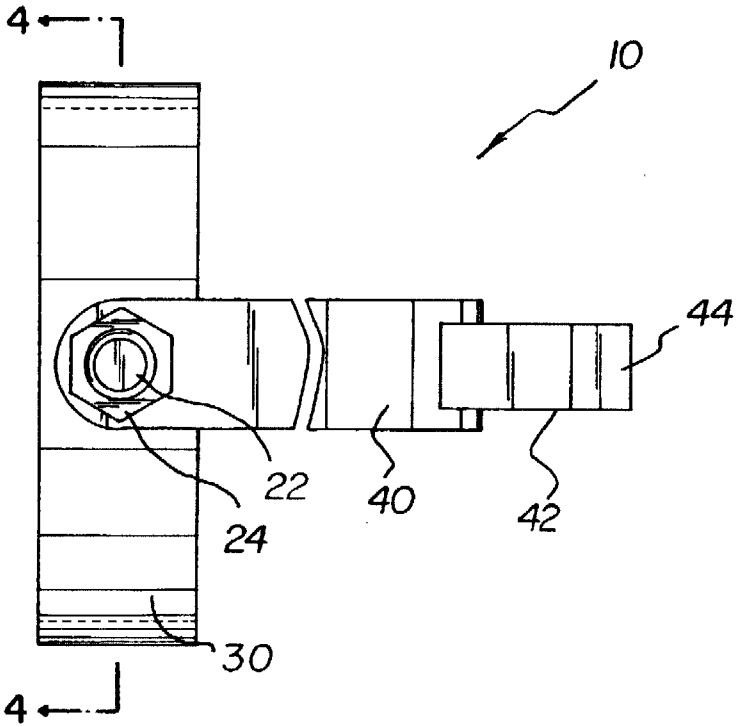
FIG. 3 is a side elevation view of the present invention.

With reference now to the drawings, and in particular to FIGS. 1 through 6 thereof, a new Articulating Pull Handle embodying the principles and concepts of the present invention and generally designated by the reference numeral 10 will be described.

More specifically, it will be noted that the Articulating Pull Handle 10 comprises a pull yoke 40, a pull ring 30, a horizontal pivot axis 20, and a vertical handle 12 where the pull yoke 40 pivotally connects a tensile load to the pull ring 30 in biaxial design with the horizontal pivot axis 20 being one of said biaxial design and the vertical handle 12 being fixedly fastened to an inner periphery of the pull ring 30.

As best illustrated in FIGS. 1 through 6, it can be shown that the horizontal pivot axis 20 further defines an axis of concentricity for a spindle bolt 22 having a bolt head 21 which is located inside the pull ring 30 and extendedly protrudes from the inner periphery of the pull ring 30 out through the pull ring 30 and the pull yoke 40 causing the pull yoke 40 to pivot with respect to the pull ring 30 along the horizontal pivot axis 20 and where the spindle bolt 22 is retainably held in place by threaded engagement with a spindle nut 24.

The pull yoke 40 further includes a pull lug 44 which is fixedly and integrally fastened to the pull yoke 40 at an end of the pull yoke 40 which is opposite the vertical handle 12 and where the pull lug 44 further includes a pull cable aperture 42 which matingly receives a pull cable for coupling to the tensile load.

Figure 5:
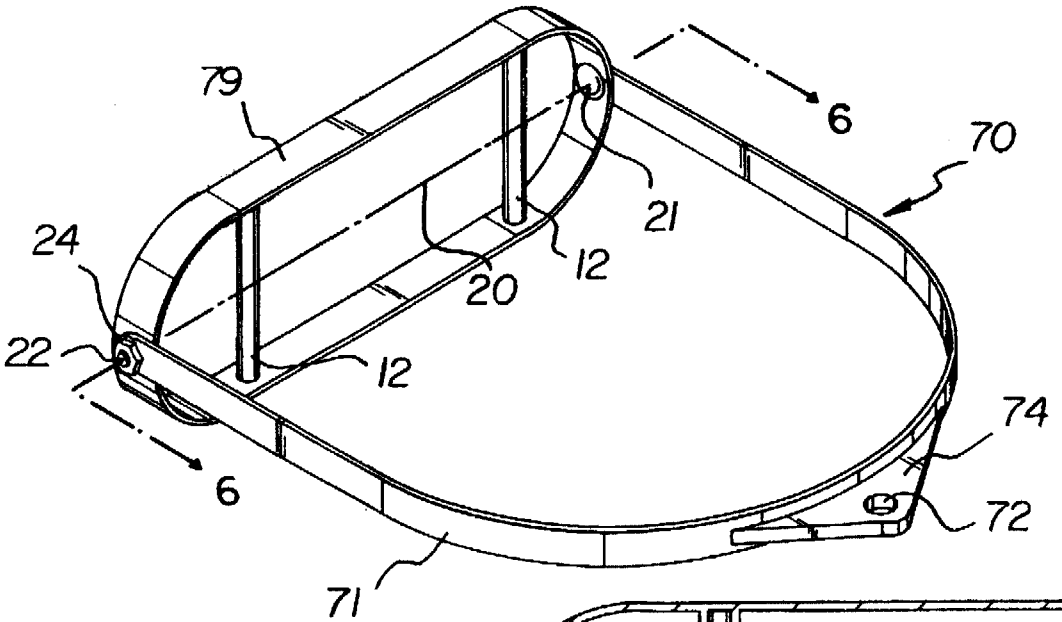
FIG. 5 is a right side perspective view of a double pull handle embodiment of a new Articulating Pull Handle according to the present invention.
Figure 6:
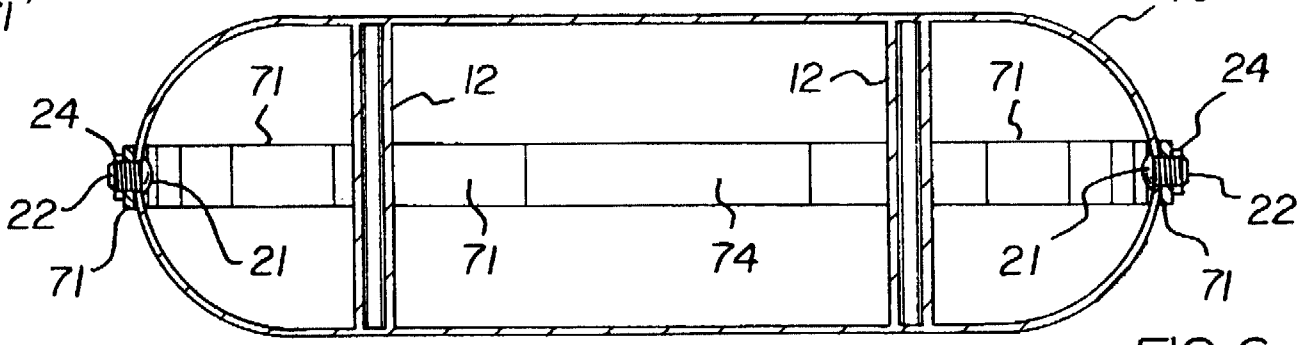
FIG. 6 is a cross sectional view taken along line 6—6 of FIG. 5.

Referring to FIGS. 5 and 6, a double handle embodiment 70 is shown to include a double pull yoke 71, having a double pull lug 74 including a double pull cable aperture 72 and where at least two handles are disposed within the periphery of a double pull ring 79 and where each the double pull yoke 71, the double pull lug 74, the double pull cable aperture 72, and the two handles disposed within the periphery of the double pull ring 79 are mechanically and tensionally connected to one another.

In use, the Articulating Pull Handle 10 is coupled to the pull cable for coupling to the tensile load of a weight machine and as the user pulls on the vertical handles 12, and the angle of arm and forearm action changes, the pull ring 30 pivots to accommodate the change and thereby reduces the stress and strain on the wrist of the user and is therefore more comfortable and effective for the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An articulating pull handle comprising:

a substantially U-shaped pull yoke having opposed ends, a pull ring having an inner periphery and being pivotally mounted to the opposed ends of said pull yoke, wherein the pull yoke is connectable to a tensile load;

wherein a spindle bolt and a spindle nut threadedly engaged thereon pivotally connect the pull ring to the pull yoke;

wherein the pull yoke further includes a pull lug fixedly and integrally fastened to the pull yoke at an end of the U-shaped pull yoke opposite the pull ring, and wherein the pull lug further includes a pull cable aperture for receiving a pull cable coupled to a tensile load; and wherein at least two spaced and parallel handles are mounted to the inner periphery of the pull ring.

2. The articulating pull handle of claim 1 wherein a pull cable is coupled to the pull cable aperture, and said pull cable is coupled to a tensile load of a weight machine.

3. The articulating pull handle of claim 1 wherein said pull ring has a substantially oval shape.

4. An articulating pull handle comprising:

a substantially oval shaped pull ring having opposed end portions and opposed side portions, a substantially U-shaped pull yoke having opposed ends, the opposed ends of said pull yoke each being pivotally mounted to an end portion of said pull ring; connecting means for connecting a load to the pull yoke and a pair of spaced parallel handles with each handle being mounted between the side portions of said pull ring.

5. The articulating pull handle of claim 4 additionally comprising a pull lug mounted to the U-shaped pull yoke at a location opposite of the opposed ends of the pull yoke.

6. The articulating pull handle of claim 5 wherein the pull lug further includes a pull cable aperture for receiving a pull cable coupled to a tensile load.

7. The articulating pull handle of claim 6 wherein said pull ring is pivotally mounted to said pull yoke by a spindle bolt and a spindle nut threadedly engaged thereon.

8. The articulating pull handle of claim 7 additionally comprising a pull cable coupled to the pull cable aperture of said pull yoke, and a tensile load coupled to said pull cable.

* * * * *